US010570924B2

(12) United States Patent
Sozer et al.

(10) Patent No.: US 10,570,924 B2
(45) Date of Patent: Feb. 25, 2020

(54) INTEGRATED MOTOR COMPRESSOR FOR VAPOR COMPRESSION REFRIGERATION SYSTEM

(71) Applicants: Yilmaz Sozer, Hudson, OH (US); Jerald K. Cohen, Hudson, OH (US); Iftekhar Hasan, Akron, OH (US); Tausif Husain, Akron, OH (US)

(72) Inventors: Yilmaz Sozer, Hudson, OH (US); Jerald K. Cohen, Hudson, OH (US); Iftekhar Hasan, Akron, OH (US); Tausif Husain, Akron, OH (US)

(73) Assignee: The University of Akron, Akron, OH (US)

( * ) Notice: Subject to any disclaimer, the term of this patent is extended or adjusted under 35 U.S.C. 154(b) by 234 days.

(21) Appl. No.: 15/612,352

(22) Filed: Jun. 2, 2017

(65) Prior Publication Data

US 2017/0350405 A1 Dec. 7, 2017

Related U.S. Application Data

(60) Provisional application No. 62/344,588, filed on Jun. 2, 2016.

(51) Int. Cl.
*F04D 25/06* (2006.01)
*F04D 29/44* (2006.01)
(Continued)

(52) U.S. Cl.
CPC ..... *F04D 29/444* (2013.01); *F04D 17/10* (2013.01); *F04D 25/0653* (2013.01); *F04D 29/284* (2013.01)

(58) Field of Classification Search
CPC .... F04D 25/0653; F04D 1/00; F04D 13/0666; F04D 17/08–10; H02K 9/06;
(Continued)

(56) References Cited

U.S. PATENT DOCUMENTS 3,194,165 A 7/1965 Sorlin
4,311,937 A * 1/1982 Clark ..... F04D 13/0666 310/268
(Continued)

FOREIGN PATENT DOCUMENTS

GB 2511082 A * 8/2014 ..... H02K 19/24

*Primary Examiner* — Charles G Freay
*Assistant Examiner* — Thomas Fink
(74) *Attorney, Agent, or Firm* — Renner, Kenner, Greive, Bobak, Taylor & Weber

(57) ABSTRACT

Embodiments provide an integrated motor-compressor assembly including a rotating impeller to compress a fluid passing therethrough, and diffuser vanes radially spaced from the impeller, each of the diffuser vanes including a stator winding therearound, the stator windings being supplied with current to generate sufficient magnetic flux for rotating the impeller. Embodiments provide an integrated motor-compressor assembly including a volute casing housing a rotating impeller to compress a fluid passing therethrough, a stator fixedly positioned in the volute casing proximate to the impeller, the stator including stator poles axially spaced from the impeller, each of the stator poles including a stator winding, the stator windings being supplied with current to generate sufficient axial magnetic flux for rotating the impeller.

10 Claims, 9 Drawing Sheets

(51) Int. Cl.
*F04D 17/10* (2006.01)
*F04D 29/28* (2006.01)

(58) Field of Classification Search
CPC ..... H02K 19/06; H02K 19/08; H02K 19/20; H02K 19/24; H02K 19/103; H02K 19/106; H02K 2201/03; H02K 1/24; H02K 1/246
See application file for complete search history.

(56) References Cited

U.S. PATENT DOCUMENTS 5,083,040 A 1/1992 Whitford et al.
6,100,618 A * 8/2000 Schoeb ..... F04D 1/006 310/90
6,220,832 B1 * 4/2001 Schob ..... F04D 1/006 417/423.5
6,293,760 B1 * 9/2001 Pais ..... F04D 13/0666 417/356
6,575,717 B2 * 6/2003 Ozaki ..... F04D 29/048 310/90.5
7,156,627 B2 1/2007 Lenderink et al.
9,835,158 B2 * 12/2017 Schob ..... F04D 1/006
2003/0161745 A1 * 8/2003 Kern ..... F04D 13/0666 417/423.7
2004/0119374 A1 * 6/2004 Carl, Jr. ..... H02K 15/0012 310/268
2007/0196215 A1 8/2007 Frosini et al.
2008/0101966 A1 * 5/2008 Lopatinsky ..... F04D 25/0653 417/423.4
2012/0095280 A1 * 4/2012 Timms ..... F04D 29/048 600/16
2012/0245680 A1 * 9/2012 Masuzawa ..... A61M 1/1086 623/3.11
2013/0164161 A1 * 6/2013 Schob ..... F04D 1/006 417/420
2014/0030122 A1 * 1/2014 Ozaki ..... H02K 5/1282 417/410.1
2015/0061428 A1 * 3/2015 Jimbo ..... H02K 21/24 310/62

* cited by examiner

INTEGRATED MOTOR COMPRESSOR FOR VAPOR COMPRESSION REFRIGERATION SYSTEM

CROSS-REFERENCE TO RELATED APPLICATIONS

The present application claims the benefit of U.S. Provisional Patent Application No. 62/344,588, filed Jun. 2, 2016, incorporated herein by reference.

FIELD OF THE INVENTION

The present invention relates to a centrifugal compressor integrated with a motor, which may also be referred to as an integrated motor-compressor assembly. The present invention further relates to an integrated motor-compressor assembly useful in a refrigeration unit, such as a vapor compression refrigeration system. The impeller and diffuser of the compressor may integrate the properties of a motor rotor and stator, respectively.

BACKGROUND OF THE INVENTION

U.S. Pat. No. 3,194,165 describes an integrated centrifugal pump/compressor and motor where a rotating disk and iron form the impeller, and the stator winding is enclosed in the casing behind the rotor.

U.S. Pat. No. 5,083,040 describes another integrated turbine-generator or compressor-motor. The turbine/compressor shares the same rotor with the generator/motor. In this arrangement, there is an axial flow turbine/compressor, and the rotor is a hollow cylinder with permanent magnet pole pieces attached at the outside, and turbine blades on the inside of the diameter.

US Pub. No. 2007/0196215 describes an integrated motor-compressor wherein the motor and compressor are two entities separated by a coupling, but integrated within a single housing.

U.S. Pat. No. 7,156,627 describes a gas-tight chamber with magnetic bearings housing the motor and compressor impellers.

SUMMARY OF THE INVENTION

In a first embodiment, the present invention provides an integrated motor-compressor assembly comprising a rotating impeller to compress a fluid passing therethrough, and diffuser vanes radially spaced from said impeller, each of said diffuser vanes including a stator winding therearound, said stator windings being supplied with current to generate sufficient magnetic flux for rotating said impeller.

In a second embodiment, the present invention provides a centrifugal compressor having impeller blades, the centrifugal compressor including stator windings and the impeller blades having a ferromagnetic portion, whereby rotation of said impeller blades is achieved by supplying current to said stator windings.

In a third embodiment, the present invention provides an integrated motor-compressor assembly comprising a volute casing housing a rotating impeller to compress a fluid passing therethrough, a stator fixedly positioned in said volute casing proximate to said impeller, said stator including stator poles axially spaced from said impeller, each of said stator poles including a stator winding, said stator windings being supplied with current to generate sufficient axial magnetic flux for rotating said impeller.

In a fourth embodiment, the present invention provides an integrated motor-compressor assembly comprising an impeller simultaneously providing compression of a fluid and acting as a rotor for a motor function, and a diffuser simultaneously providing diffusion of the fluid and acting as a stator for the motor function.

In a fifth embodiment, the present invention provides an assembly as in any of the above embodiments, further comprising a volute casing having a diffuser portion housing said diffuser vanes and said stator windings, said volute casing including an inlet and an outlet, said outlet being transverse to said inlet.

In a sixth embodiment, the present invention provides an assembly as in any of the above embodiments, wherein if said inlet is positioned in the y-dimension plane, said outlet is positioned in the x-dimension plane, and if said inlet is positioned in the x-dimension plane, said outlet is positioned in the y-dimension plane.

In a seventh embodiment, the present invention provides an assembly as in any of the above embodiments, at least a portion of each diffuser vane being positioned on an annularly-shaped back iron.

In an eighth embodiment, the present invention provides an assembly as in any of the above embodiments, further comprising an inverter coupled with said stator windings, said inverter supplying the current to said stator windings.

In a ninth embodiment, the present invention provides an assembly as in any of the above embodiments, said stator windings being made from magnet wire, cast copper, or cast aluminum, said impeller including impeller blades having at least a portion thereof made from a ferromagnetic material, and said back iron and said diffuser vanes being made from a ferromagnetic material.

In a tenth embodiment, the present invention provides an assembly as in any of the above embodiments, wherein said stator windings are short-pitched winding.

In an eleventh embodiment, the present invention provides an assembly as in any of the above embodiments, wherein said stator windings are full-pitched winding.

In a twelfth embodiment, the present invention provides an assembly as in any of the above embodiments, further comprising an electronic control system to sequentially switch on the stator windings of successive pairs of said diffuser vanes, thereby leading the rotation of said impeller.

In a thirteenth embodiment, the present invention provides an assembly as in any of the above embodiments, wherein the assembly acts as a switched reluctance machine.

In a fourteenth embodiment, the present invention provides an assembly as in any of the above embodiments, wherein the assembly is designed based on the following equations:

$$N_s=2N_{ph}N_{rep}$$

$$N_r=N_s-2N_{rep}$$

where, $N_s$ is the number of diffuser vanes, $N_r$ is the number of impeller blades, $N_{ph}$ is the number of phases for the stator windings, and $N_{rep}$ is the number of repetitions.

In a fifteenth embodiment, the present invention provides an assembly as in any of the above embodiments, wherein the stator windings are controlled via an H-bridge converter per phase.

In a sixteenth embodiment, the present invention provides an assembly as in any of the above embodiments, wherein the assembly is contained within a single housing.

In a seventeenth embodiment, the present invention provides an assembly as in any of the above embodiments, wherein the assembly is devoid of an external motor having a coupling to drive the impeller, the impeller being driven solely by interaction between said stator windings and said impeller blades.

In an eighteenth embodiment, the present invention provides an assembly as in any of the above embodiments, wherein the assembly is contained within a single housing and is devoid of an external motor having a coupling to drive the impeller, the impeller being driven solely by interaction between said stator windings and said impeller.

In a nineteenth embodiment, the present invention provides an assembly as in any of the above embodiments, wherein the fluid is a refrigerant.

In a twentieth embodiment, the present invention provides an assembly as in any of the above embodiments, said impeller including impeller blades, said impeller blades including a first portion and a second portion, the second portion providing a rotor for the motor function, wherein said diffuser includes diffuser vanes, wherein said impeller blades define rotor poles and said diffuser vanes define stator poles, wherein there are an unequal number of stator poles and rotor poles, to thereby ensure that not all stator poles and rotor poles are aligned or unaligned at the same instant.

BRIEF DESCRIPTION OF THE DRAWINGS

Advantages of the present invention will become better understood with regard to the following description, appended claims, and accompanying drawings wherein:

DETAILED DESCRIPTION OF ILLUSTRATIVE EMBODIMENTS

Figure 1:
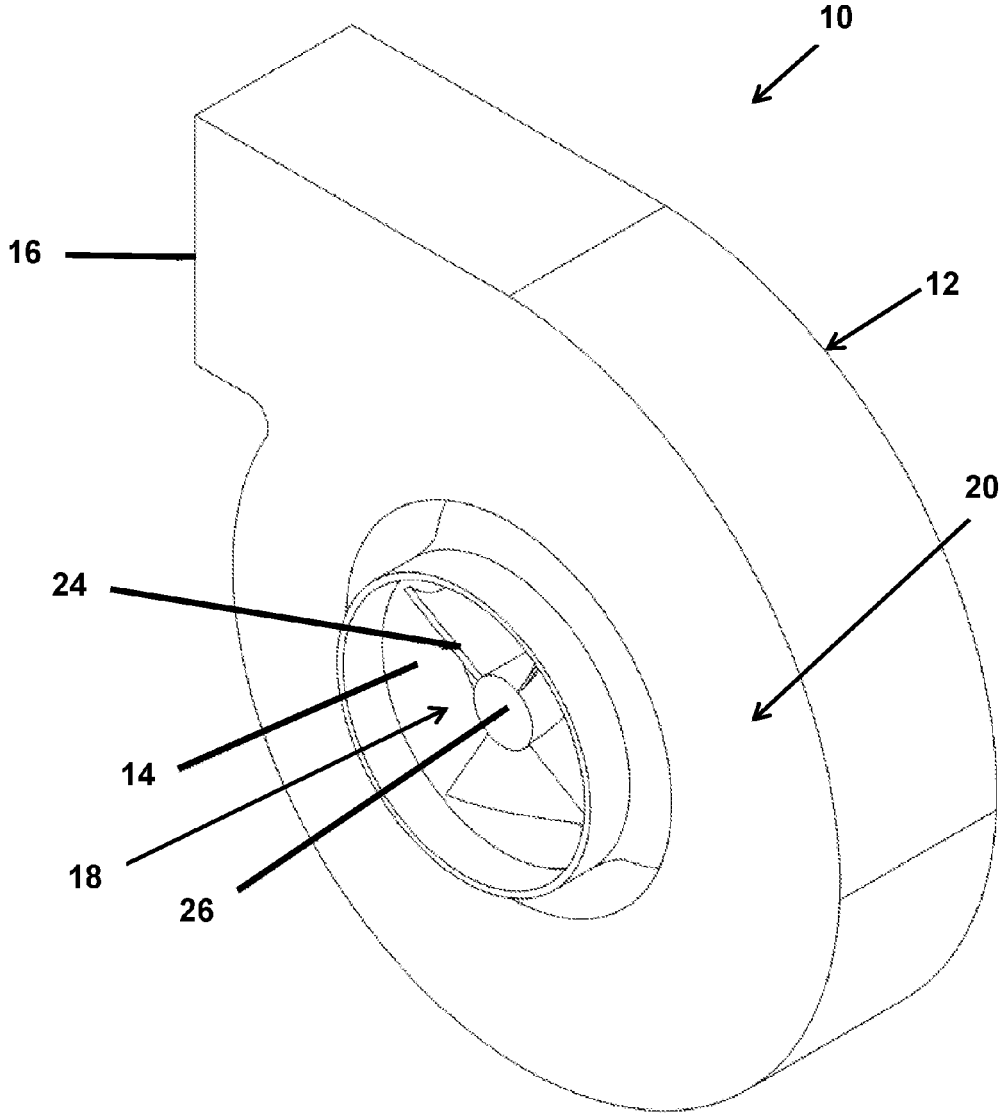
FIG. 1 is a perspective view of an integrated motor-compressor assembly according to embodiments of the invention.

With reference to FIGS. 1-4, the present invention provides an integrated motor-compressor assembly (herein also referred to as a motor-compressor assembly or motor-compressor), generally indicated by the numeral 10. Motor-compressor 10, includes a volute casing, generally indicated by the numeral 12, having an inlet 14 and an outlet 16. In a manner generally known in the art, an impeller, generally indicated by the numeral 18, is positioned in volute casing 12 to rotate therein relative to a diffuser, generally indicated by the numeral 20, to entrain fluid into inlet 14 and expel it at outlet 16. In the prior art, the impeller would typically be driven by a shaft driven by an external, separate and distinct motor; however, in the invention, impeller 18, in addition to serving as a compressor impeller, also serves as the rotor of an electric motor, with diffuser vanes 22 of the motor-compressor assembly 10 serving as the stator of that electric motor. Thus, the use of the name "integrated motor-compressor assembly" for the present invention. The impeller of this invention uniquely serves as an impeller/rotor in the present invention, and the diffuser of this invention uniquely serves as a diffuser/stator.

In known fashion, impeller 18 fits within volute casing 12 with close tolerance between the distal ends 23 of a plurality of impeller blades 24 and an inlet sidewall 25 of volute casing 12. Inlet sidewall 25 ends to form a circumferential opening 27 into the discharge annulus 29 of the volute casing 12. Diffuser vanes 22 of diffuser 20 extend through circumferential opening 27, and are radially spaced from impeller 18. Neighboring diffuser vanes 22 define segmented flow paths for fluid advanced by impeller 18. At least a portion of each diffuser vane 22 is positioned on an annular back iron 30. Diffuser vanes 22 and back iron 30 may be made from ferromagnetic material as to particularly serve as the stator for motor-compressor 10. Exemplary ferromagnetic materials include iron, nickel, cobalt, and most of their alloys, and other known materials. In some embodiments, only a portion of diffuser vanes 22, such as inner distal end 37, and back iron 30 is made of ferromagnetic material based on desired design of motor-compressor assembly 10, such as for desired power and torque. In such embodiments, skilled artisans will appreciate that a sufficient amount of ferromagnetic material may be provided between inner distal end 37 and back iron 30 to ensure functioning of the stator.

Impeller blades 24 may include a first portion 32, which may be described as a top portion, and a second portion 34, which may be described as a bottom portion. As will be described herein below, bottom portion 34 may be made from a ferromagnetic material to particularly interact with the stator, i.e. stator windings 36 on diffuser vanes 22, and thus serve as the rotor for motor-compressor 10. Similar to diffuser vanes 22 and back iron 30, in some embodiments, only a portion of bottom portion 34 may be made of ferromagnetic material based on desired design of motor-compressor assembly 10, such as for desired power and torque.

Impeller blades 24 may be shaped as generally known in the art. The shape of impeller blades 24 may be generally described as having a backward curve 31 (FIG. 4) with a twist from the top 33 to the bottom 35. The use of the word backward is based on the convex shape facing the direction of impeller 18 travel. The shape of impeller blades 24 is best seen in FIG. 2 and FIG. 4.

To enact compression of a fluid (flow shown generally by arrows in FIG. 2), impeller 18 rotates generally centrally within the inlet portion of volute casing 12 (counterclockwise in the orientation of FIG. 2), and fluid is drawn into the motor-compressor assembly 10 vertically downward (in the orientation of FIG. 2, which is simply for reference sake) through inlet 14. The fluid is then drawn down along the height of impeller blades 24, changing direction at each blade tip 41 of impeller blades 24 and exiting tangentially in light of the close tolerance between blade tips 41 and the inner distal end 37 of each diffuser vane 22. The fluid thus flows between each neighboring pair of diffuser vanes 22 and through volute casing 12 and finally exits at outlet 16 horizontally. Although inlet 14 is shown and described as being vertically oriented, and outlet 16 is shown and described as being horizontally oriented, it should be appreciated that inlet 14 and outlet 16 may take other orientations while maintaining their respective transverse orientation. This may also be described as when inlet 14 is positioned in the y-dimension plane, outlet 16 is positioned in the x-dimension plane, and when inlet 14 is positioned in the x-dimension plane, outlet 16 is positioned in the y-dimension plane.

Figure 2:
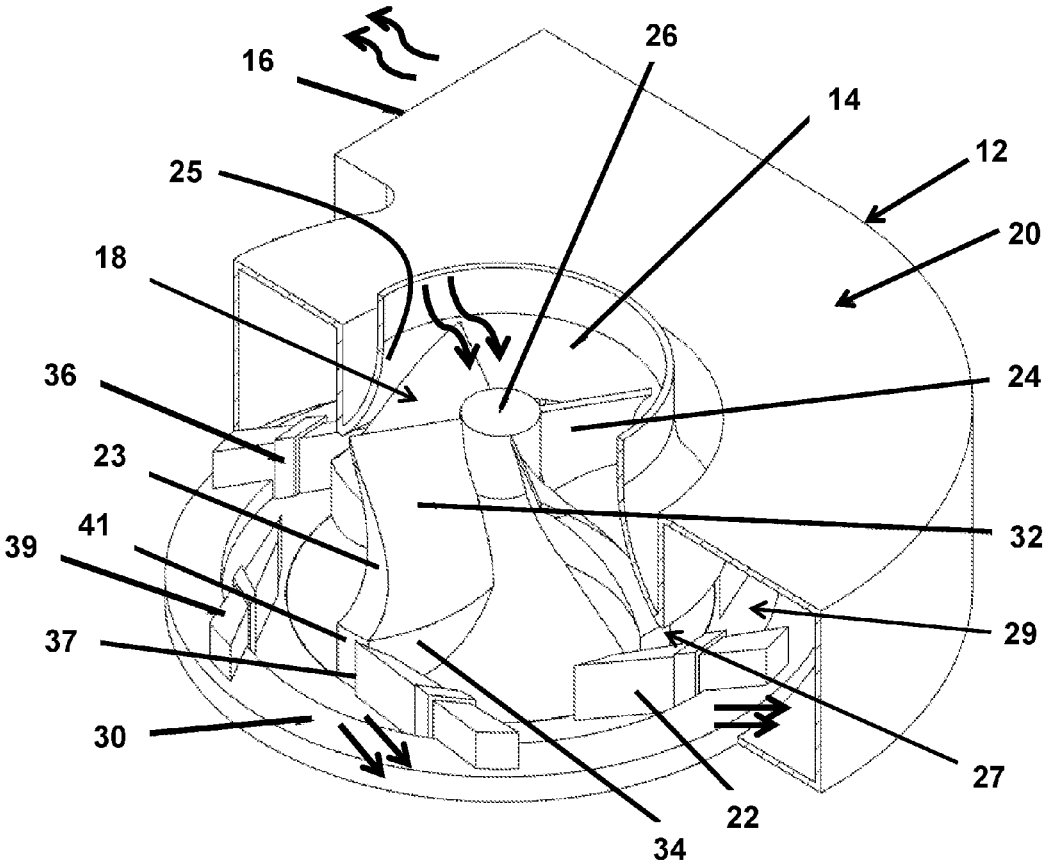
FIG. 2 is a perspective view of the integrated motor-compressor assembly showing a cutaway view of a volute casing.
Figure 3A:
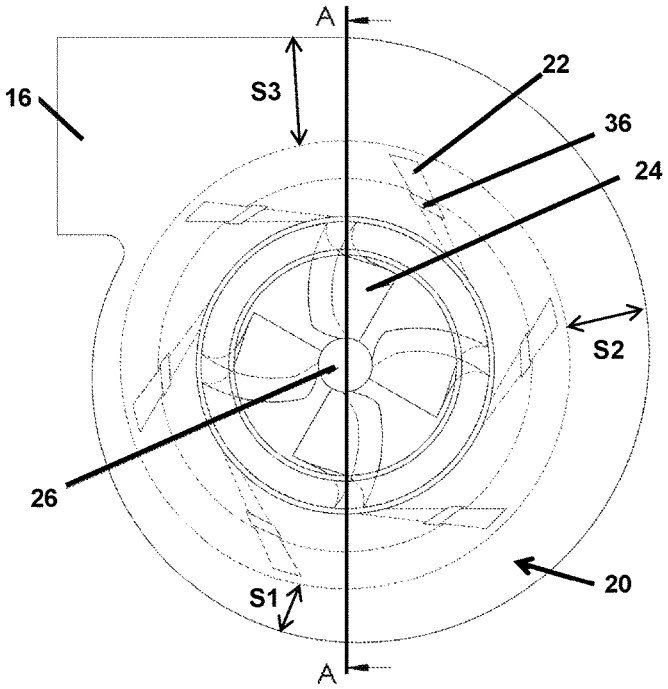
FIG. 3A is an elevational view showing the integrated motor-compressor assembly with hidden line views of certain components thereof.
Figure 3B:
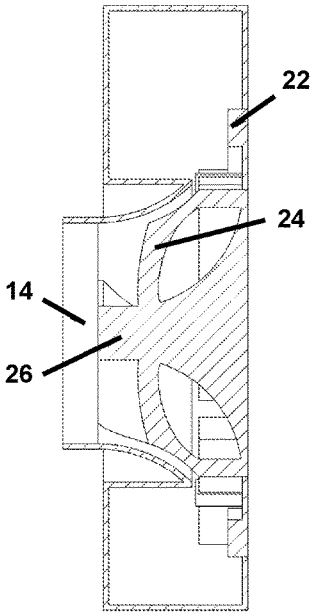
FIG. 3B is a cross-sectional view taken along line A-A of FIG. 3A.
Figure 4:
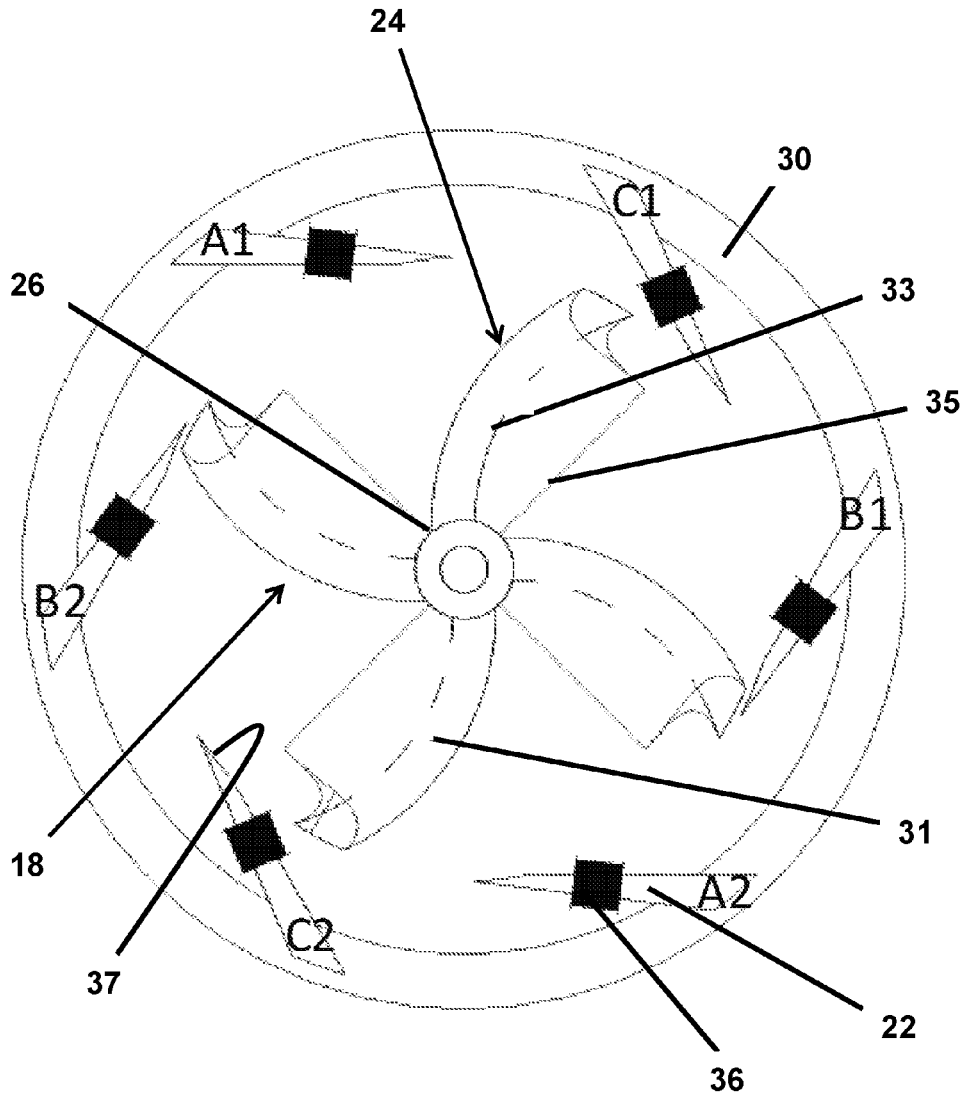
FIG. 4 is an elevational view showing an impeller, diffuser vanes, and stator windings according to embodiments of the invention.

The orientation of diffuser vanes 22 is best shown in FIG. 2 and FIG. 4. Diffuser vanes 22, which may also be referred to as diffuser blades, stator vanes, or stator teeth, form a diffusing angle to create a passage of increasing volume in the general direction of fluid flow, thereby decreasing fluid velocity and increasing the pressure of the fluid. The remainder of the kinetic energy is converted into pressure head in the discharge annulus 29 with an increasing cross-sectional area as the fluid moves towards outlet 16, which can been seen in FIG. 3A. As generally shown, the cross-sectional area at S1 is less than the cross-sectional area at S2, which is less than the cross-sectional area at S3.

Diffuser vanes 22 include stator windings 36, which may also be referred to as windings, stator coils, or phase coils, which may be wound around a portion of the body of diffuser vanes 22. Stator windings 36 receive current which drives impeller 18, particularly through interaction with ferromagnetic bottom portion 34 of impeller blades 24 and back iron 30. Each diffuser vane 22 includes a stator winding 36 to achieve a switched reluctance motor, as described below. As mentioned above, an outer portion 39 of each diffuser vane 22 may be positioned on back iron 30 as to facilitate flux generation. The generated radial flux is sufficient to rotate impeller 18.

Stator windings 36 are supplied with current through a multi-phase power inverter (not shown) coupled with stator windings 36, to thereby achieve an integrated switched reluctance motor, also called a switched reluctance machine (SRM). Stator windings 36 are also multi-phase, and may include an H-bridge converter per phase, to thereby generate the torque when coupled with the multi-phase inverter. Stator windings 36 may extend beyond a back surface of volute casing 12 in order to couple stator windings 36 with the inverter. Stator windings 36 may include input terminals for particular coupling with inverter. Other configurations for coupling an inverter with stator windings 36 may be generally known to those skilled in the art.

Other details of SRM's may be generally known to those skilled in the art, although the present invention is uniquely an SRM having both a compressor function and a motor function. As known, SRM operation includes excitation only on the stator; thus, the present invention includes excitation only on the stator/diffuser. SRM operates on the reluctance principle in which the tendency of an electromagnetic system is to attain a stable equilibrium position of minimum reluctance. As generally known, in order to maintain rotation of impeller 18, an electronic control system (including the multi-phase power inverter) switches on the stator windings 36 of successive pairs of diffuser vanes 22 in sequence so that the magnetic field of the stator/diffuser 'leads' the rotor/impeller, pulling it in forward rotation.

Figure 5:
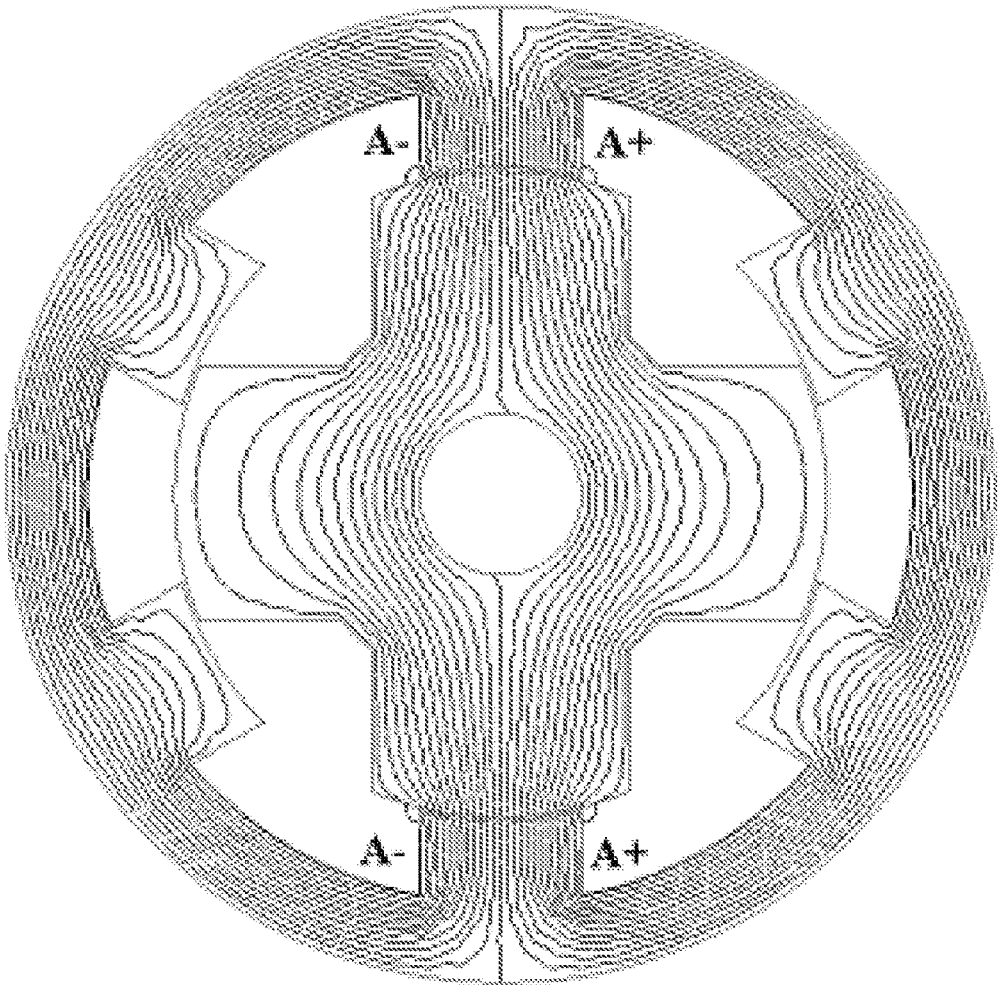
FIG. 5 is a schematic showing an exemplary 2D electromagnetic flux path for the integrated motor-compressor.
Figure 6:
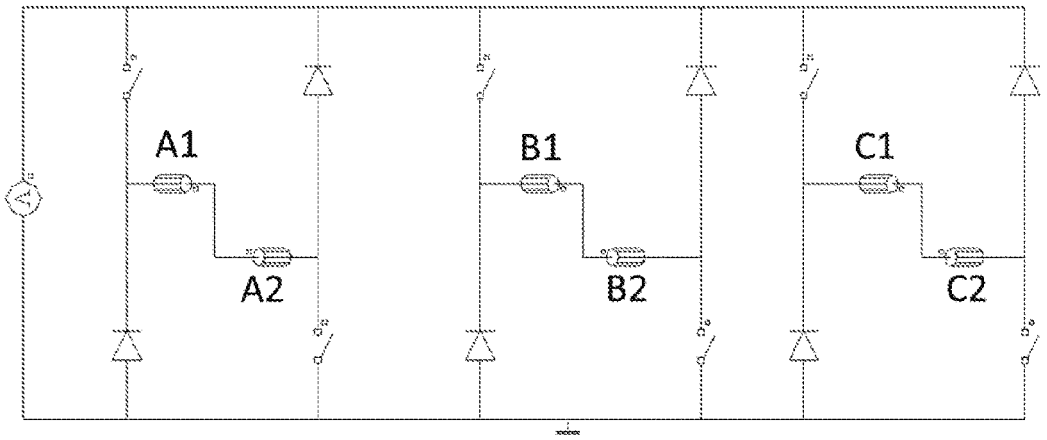
FIG. 6 is a schematic showing an exemplary electrical drive system used to provide multiphase excitation to the stator windings of a motor-compressor assembly according to embodiments of the invention.

Said another way, for operation of motor-compressor assembly 10, when a phase is excited using the drive system shown in FIG. 4 and FIG. 6, (wherein different pairs of opposed diffuser vanes are represented by A1/A2, B1/B2, and C1/C2, as shown) a flux induced in the diffuser/stator poles flows through the impeller/rotor structure, as shown in FIG. 5. This results in the impeller/rotor being attracted towards the diffuser/stator to achieve minimum reluctance. Impeller blades 24 define impeller/rotor poles and diffuser vanes 22 define diffuser/stator poles, and the movement of the impeller/rotor poles with respect to the diffuser/stator poles results in a gradual increase and decrease of the reluctance and flux linkage. The minimum reluctance position, also known as the aligned position, is also where the inductance and flux linkage are maxima. The impeller/rotor has minimum inductance and flux linkage when an impeller/rotor pole is exactly in between two diffuser/stator poles, which may also be described as being completely unaligned. The unequal number of diffuser/stator poles and impeller/rotor poles is important since this ensures that not all corresponding diffuser/stator poles and impeller/rotor poles are aligned or unaligned at the same instant. Other details of the operation of motor-compressor assembly 10 may be known to those skilled in the art, particularly as related to operation of known centrifugal compressors and known motors.

Stator windings 36 may be made from magnet wire, cast copper, or cast aluminum. Stator windings 36 may be said to occupy little area so as not to impede the flow of the fluid as it flows through diffuser 20. The fluid flow may also actively cool windings 36.

Stator windings 36 may be either short-pitched winding or full-pitched winding, where the winding structure determines certain aspects of motor-compressor assembly 10. Stator windings 36 may be short-pitched winding, where self-inductance plays a crucial role in torque production. Stator windings 36 may be full-pitched winding, where mutual inductance dominates in the production of torque. The windings for full-pitch magnetic topology may be said to close on each stator, keeping end turns as short as possible.

Diffuser vanes 22 are grouped into phases consistent with SRM operation and alignment between stator and rotor poles. The magnetic polarity of stator windings 36, alternates to minimize the mutual coupling among the phases. The present winding configuration may be said to lead to larger variations in self-inductance and, under some operating conditions, may result in higher torque production. An exemplary flux path is particularly shown in FIG. 5.

In one or more embodiments, motor-compressor 10 operates in continuous-conduction-mode (CCM), where the current provided to stator windings 36 does not go to zero between switching cycles. In one or more embodiments, motor-compressor 10 operates in discontinuous-conduction-mode (DCM), where the current provided to stator windings 36 goes to zero during part of the switching cycle. Whether CCM or DCM is utilized may depend on a desired design for motor-compressor 10.

Although a particular number of impeller blades 24 and diffuser vanes 22 are shown in the Figures, other numbers may be utilized when designing a motor-compressor 10. Motor-compressor 10 may be designed based on the following equations:

$$N_s=2N_{ph}N_{rep}$$

$$N_r=N_s-2N_{rep}$$

where, $N_s$ is the number of stator/diffuser vanes, $N_r$ is the number of rotor/impeller blades, $N_{ph}$ is the number of phases for the stator windings, and $N_{rep}$ is the number of repetitions.

As particularly shown in the FIGS. 1-4, an exemplary design for motor-compressor 10 is $N_s$=6, $N_r$=4, $N_{ph}$=3, and $N_{rep}$=1. Another exemplary design for motor-compressor 10 includes $N_s$=12, $N_r$=8, $N_{ph}$=3, and $N_{rep}$=2.

Figure 7:
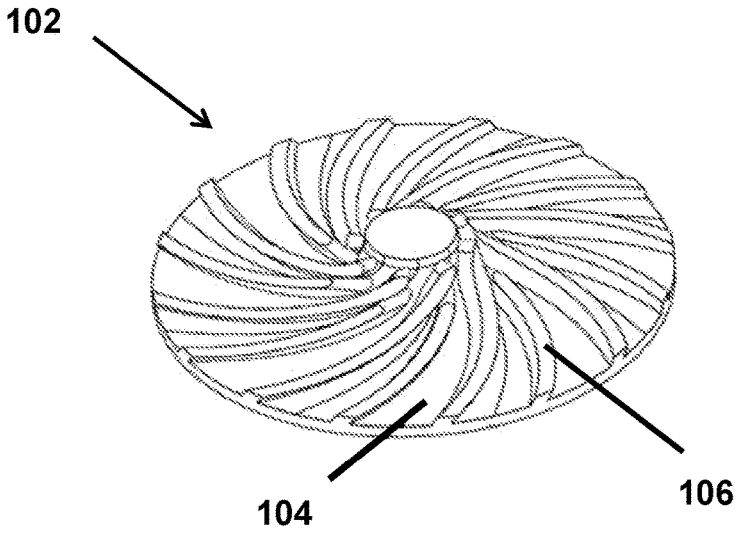
FIG. 7 is a perspective view of a rotor/impeller according to embodiments of the invention.
Figure 8:
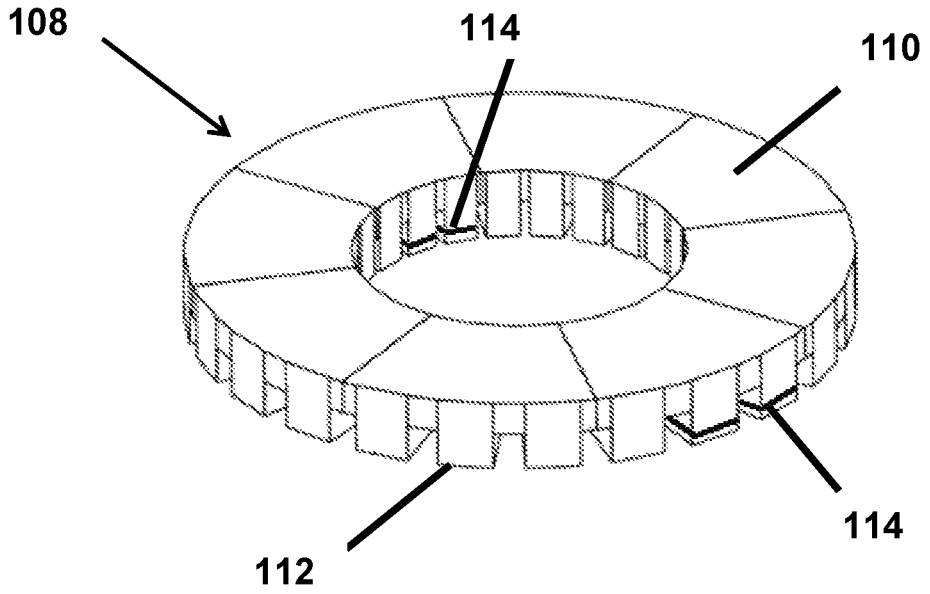
FIG. 8 is a perspective view of a stator according to embodiments of the invention.
Figure 9:
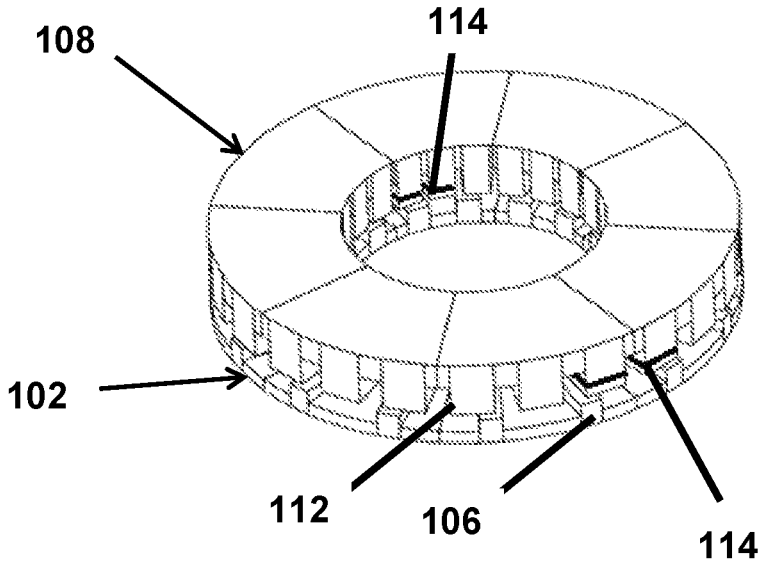
FIG. 9 is a perspective view of a stator and rotor combination according to embodiments of the invention.

With reference to FIGS. 7-9, in one or more embodiments of the invention, motor-compressor 10 may be designed as to generate axial flux, where motor-compressor 10 includes a rotor 102 and a stator 108. In these embodiments, diffuser 20 would not include stator windings 36 on diffuser vanes 22 (as further discussed below), but diffuser 20 otherwise remains the same as above. The lack of stator windings 36 on diffuser vanes in these embodiments may provide improved fluid flow through diffuser, and therefore improved compression, based on the extra available space compared to when diffuser vanes 22 are present. Rotor 102 defines part of an impeller, such as impeller 18 described above, and includes back iron 104 and impeller blade portions 106, which may be described as a bottom portion. The impeller blades also include a top portion (not shown in FIGS. 7-9) similar to first portion 32. It should be appreciated that FIG. 9 shows a central cutout where the remainder of the impeller, e.g. top portion of impeller blades, would be positioned.

Rotor 102 rotates in proximity to a stator 108 fixedly positioned in volute casing 12. Stator 108 is axially spaced from rotor 102 and includes an annular back iron 110 having stator poles 112 extending therefrom toward rotor 102. Each stator pole 112 includes stator windings 114 wound lengthwise around the stator pole 112.

The above description with respect to the characteristics and operation of the motor function of motor-compressor 10 is also applicable to embodiments utilizing rotor 102 and stator 108, though a summary is provided here. Back iron 104, impeller blade portions 106, back iron 110, and stator poles 112 may be made from ferromagnetic material, or a sufficient portion of these components may be made from ferromagnetic material. Stator windings 114 may be made from magnet wire, cast copper, or cast aluminum and are supplied with current through a multi-phase power inverter (not shown) coupled with stator windings 114, to thereby achieve an integrated axial airgap SRM. Stator windings 114 may be either short-pitched winding or full-pitched winding. Stator windings 114 may include input terminals for particular coupling with the inverter. To maintain rotation of rotor 102 and the impeller, an electronic control system (including the multi-phase power inverter) switches on the stator windings 114 of successive pairs of stator poles 112 in sequence so that the magnetic field of the stator 112 'leads' the rotor/impeller, pulling it in forward rotation.

It should be appreciated that motor-compressor 10 may be further characterized according to various properties. Properties of motor-compressor 10 that may be adjusted based on a desired design include: rotor radius, rotor-stator distance, fluid flow rate, number of turns, impeller speed, compression pressure ratio, voltage, current, average torque, and output power. The skilled artisan will be able to adjust these properties, as necessary, to achieve a suitable operation for a desired design.

In one or more embodiments, the fluid may be a refrigerant. In one or more embodiments, the fluid may be ammonia, sulfur dioxide, $CO_2$ (R-744), dimethyl ether, chlorofluorocarbons (CFCs), hydrochlorofluorocarbons (HCFCs), perfluorocarbons (FCs), hydrofluorocarbons (HFCs), and non-halogenated hydrocarbons, such as propane.

Motor-compressor 10 may be designed for suitable use with a vapor compression refrigeration system, also described as a small refrigeration unit. An object of the present invention is a compact design, thereby making motor-compressor 10 attractive for use with a refrigeration system. Motor-compressor 10 may be capable of generating the high-pressure ratio required by typical refrigeration systems.

Another object of the invention is to achieve an energy efficient apparatus for refrigeration systems. Traditionally, as mentioned above, a prior art compressor used in a refrigeration system is coupled with a motor by a gear box or directly with a shaft. Motor-compressor 10 does not need an external coupling or gear box. Thus, it may achieve the properties of being cost-effective and compact.

In light of the foregoing, it should be appreciated that the present invention advances the art by providing an integrated motor-compressor assembly. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

EXAMPLES

Example 1

Figure 10:
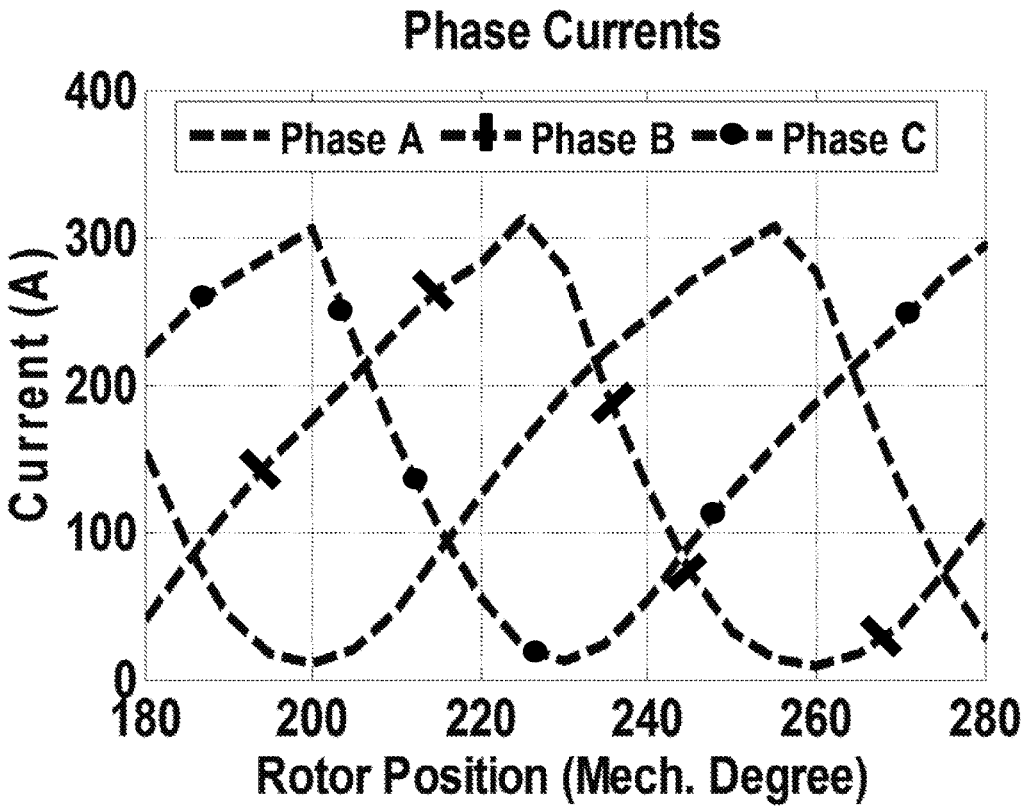
FIG. 10 is a graph showing exemplary phase currents.
Figure 11:
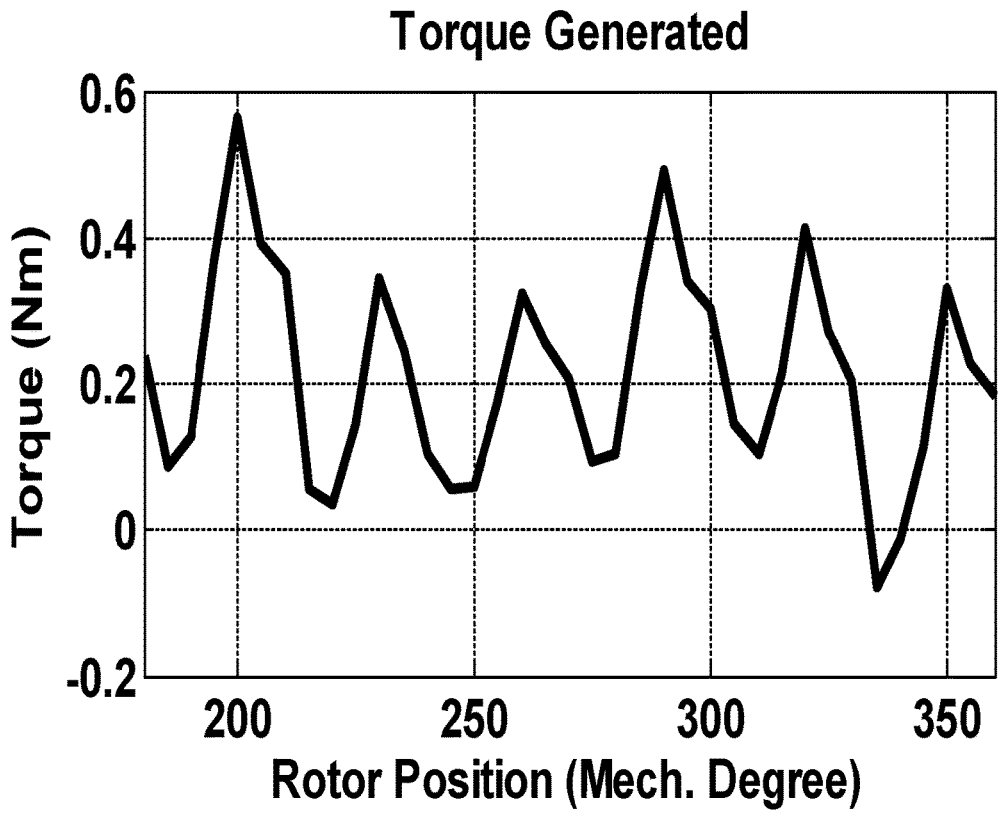
FIG. 11 is a graph showing exemplary torque generation.

A numerical study was carried out to solve for the fluid flow in a motor-compressor using a Multiple Reference Frame Technique in a commercial CFD solver, ANSYS Fluent. With an inlet pressure of 60 psi, impeller speed of 90000 rpm, and a target mass flow rate for a 3 kW cooling load refrigeration system using R134a, a pressure ratio of 3 was achieved. Pressure contours and velocity vectors in a plane 0.3 inch above the base of diffuser, and parallel to it, were calculated. In the velocity vector plot, it was observed that the fluid accelerated towards the impeller blade tip, and then decelerated as it flowed through the diffuser vanes and the volute. This velocity head of the fluid was converted into pressure head, which was evident from the calculated pressure contours. The magnetic flux density distribution in the diffuser/stator and impeller/rotor of the integrated motor-compressor were also calculated. Exemplary multi-phase excitation currents are shown in FIG. 10, which indicates the motor of the integrated motor-compressor was being operated in continuous conduction mode. Exemplary generated torque is shown FIG. 11

TABLE 1

Example 1 Results
Design and Performance

| | |
|---|---|
| Number of turns | 75 |
| Speed | 90000 rpm |
| Pressure Ratio | 3 |
| DC BUS | 300 V |
| RMS Current | 152 A |
| Average torque | 0.33 Nm |
| Output power | 3 kW |

Various modifications and alterations that do not depart from the scope and spirit of this invention will become apparent to those skilled in the art. This invention is not to be duly limited to the illustrative embodiments set forth herein.

What is claimed is:

1. An integrated motor-compressor assembly comprising a volute casing having an inlet, an outlet, and a volute between said inlet and said outlet, a stator fixedly positioned in said volute casing, said stator having a central opening and a plurality of stator teeth with windings, a rotating impeller having a plurality of ferromagnetic blades wherein said blades and said stator teeth axially face each other separated by an axial gap thereby achieving an integrated switch reluctance motor, said stator windings being supplied with current to generate sufficient axial magnetic flux across said axial gap for rotating said impeller to draw a fluid via said inlet, through said central opening and onto said impeller blades to compress said fluid and discharge said fluid through said volute and out said outlet.

2. The assembly of claim 1, wherein the assembly is devoid of an external motor having a coupling to drive the impeller, the impeller being driven solely by interaction between said stator windings and said impeller.

3. The assembly of claim 1, further comprising an inverter coupled with said stator windings, said inverter supplying the current to said stator windings.

4. The assembly of claim 3, further comprising diffuser vanes radially spaced from said impeller, said stator windings being made from magnet wire, cast copper, or cast aluminum, and said impeller including a rotor back iron, said rotor back iron and said diffuser vanes being made from a ferromagnetic material.

5. The assembly of claim 4, wherein said stator windings are short-pitched winding.

6. The assembly of claim 4, wherein said stator windings are full-pitched winding.

7. The assembly of claim 4, further comprising an electronic control system to sequentially switch on the stator windings of successive pairs of said stator poles, thereby leading the rotation of said impeller.

8. The assembly of claim 4, wherein the assembly is designed based on the following equations:

$$N_S=2N_{ph}N_{rep}$$

$$N_r=N_s-2N_{rep}$$

where, $N_s$ is the number of stator poles, $N_r$ is the number of impeller blades, $N_{ph}$ is the number of phases for the stator windings, and $N_{rep}$ is the number of repetitions.

9. The assembly of claim 4, wherein the stator windings are controlled via an H-bridge converter per phase.

10. The assembly of claim 4, wherein the assembly is devoid of an external motor having a coupling to drive the impeller, the impeller being driven solely by interaction between said stator windings and said impeller blades.

* * * * *